US011754335B2

(12) United States Patent
Li et al.

(10) Patent No.: US 11,754,335 B2
(45) Date of Patent: Sep. 12, 2023

(54) REFRIGERATION APPLIANCE WITH A STORAGE BOX

(71) Applicant: BSH Hausgeraete GmbH, Munich (DE)

(72) Inventors: Ertao Li, Nanjing (CN); Jiajun Li, Nanjing (CN); Ting Yi, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/688,980

(22) Filed: Mar. 8, 2022

(65) Prior Publication Data

US 2022/0290913 A1 Sep. 15, 2022

(30) Foreign Application Priority Data

Mar. 10, 2021 (CN) ..... 202110259645.7

(51) Int. Cl.
*F25D 25/02* (2006.01)
*F25D 17/04* (2006.01)

(52) U.S. Cl.
CPC ..... *F25D 25/025* (2013.01); *F25D 17/045* (2013.01); *A47B 2210/17* (2013.01); *F25D 2317/04131* (2013.01)

(58) Field of Classification Search
CPC .... F25D 23/028; F25D 25/025; F25D 25/005; F25D 17/045; F25D 2317/04131; A47B 2210/17
See application file for complete search history.

(56) References Cited

U.S. PATENT DOCUMENTS

| | | | | |
|---|---|---|---|---|
| 9,677,806 | B2 * | 6/2017 | Bischofberger | F25D 25/025 |
| 10,260,799 | B2 * | 4/2019 | Becke | F25D 29/005 |
| 10,830,530 | B2 * | 11/2020 | Alyanak | F25D 25/02 |
| 10,962,281 | B2 * | 3/2021 | Lee | F25D 25/005 |
| 2012/0146477 | A1 * | 6/2012 | Bischofberger | F25D 25/025 312/404 |
| 2018/0187966 | A1 * | 7/2018 | Lee | F25D 17/042 |

FOREIGN PATENT DOCUMENTS

| | | | | |
|---|---|---|---|---|
| DE | 102009029139 | A1 | 3/2011 | |
| DE | 102009029145 | A1 * | 3/2011 | F25D 21/14 |
| WO | 2016107746 | A1 | 7/2016 | |
| WO | 2016107748 | A1 | 7/2016 | |

* cited by examiner

*Primary Examiner* — Kimberley S Wright
(74) *Attorney, Agent, or Firm* — Laurence A. Greenberg; Werner H. Stemer; Ralph E. Locher

(57) ABSTRACT

A refrigeration appliance has a storage box with an open upper end. First and second hanging pins are disposed on a cover plate. The first hanging pin is hung in a first hanger loop and is movable in a front-rear direction and/or an up-down direction in the first hanger loop. The second hanging pin is hung in a second hanger loop and is movable in the front-rear direction and/or the up-down direction in the second hanger loop. The cover plate is movable in the front-rear direction and/or the up-down direction relative to the storage box to at least partially open and close the storage box. The first hanger loop includes an open section that enables the first hanging pin to enter the first hanger loop from the open section and the cover plate of the refrigeration appliance is thereby easy to install.

18 Claims, 6 Drawing Sheets

REFRIGERATION APPLIANCE WITH A STORAGE BOX

CROSS-REFERENCE TO RELATED APPLICATION

This application claims the priority, under 35 U.S.C. § 119, of Chinese Patent Application CN 202110259645.7, filed Mar. 10, 2021; the prior application is herewith incorporated by reference in its entirety.

FIELD AND BACKGROUND OF THE INVENTION

The present invention relates to the technical field of household appliances, and more particularly to a refrigeration appliance.

Some existing refrigeration appliances include a storage box with an upper end being open and a cover plate configured to close and open the storage box. The cover plate of the storage box in the prior art is tedious and difficult to install. For example, according to a known process of installing the cover plate, the cover plate needs to be bent at first, then, a hanging pin on the cover plate is inserted into a hanger loop, and next, the cover plate restores an original shape.

SUMMARY OF THE INVENTION

It is accordingly an object of the invention to provide a refrigeration appliance which overcomes the above-mentioned and other disadvantages of the heretofore-known devices and methods of this general type and which provides for a refrigeration appliance the cover plate of which is easy to install.

With the above and other objects in view there is provided, in accordance with the invention, a refrigeration appliance, comprising:

a storage box having an open upper end and a cover plate disposed on the storage box;

a first hanging pin and a second hanging pin disposed on the cover plate;

a first hanger loop and a second hanger loop;

the first hanging pin being hung in the first hanger loop and being movable in at least one of a front-rear direction or an up-down direction in the first hanger loop;

the second hanging pin being hung in the second hanger loop and being movable in at least one of the front-rear direction or the up-down direction in the second hanger loop;

the cover plate being movable in at least one of the front-rear direction or the up-down direction relative to the storage box to at least partially open and close the storage box; and the first hanger loop being formed with an open section enabling the first hanging pin to enter the first hanger loop via the open section.

In other words, the refrigeration appliance includes a storage box with an upper end being open; a first hanger loop and a second hanger loop; a first hanging pin and a second hanging pin; and a cover plate located on the storage box. The first hanging pin and the second hanging pin are disposed on the cover plate. The first hanging pin is hung in the first hanger loop, and the first hanging pin is movable in a front-rear direction and/or an up-down direction in the first hanger loop. The second hanging pin is hung in the second hanger loop, and the second hanging pin is movable in the front-rear direction and/or the up-down direction in the second hanger loop. The cover plate is movable in the front-rear direction and/or the up-down direction relative to the storage box to at least partially open and close the storage box. The first hanger loop includes an open section. The first hanging pin is configured to be able to enter the first hanger loop from the open section.

In one or more possible implementations, the first hanging pin is located at a front end of the cover plate and extends from the cover plate to a left side or a right side; and a front portion and/or a top portion of the first hanger loop is provided with the open section.

In one or more possible implementations, the first hanger loop includes a U-shaped first bearing portion, the first hanger loop is configured to allow the first hanging pin to enter the first bearing portion from the open section and allow the first hanging pin to move in the front-rear direction and/or the up-down direction in the first bearing portion.

In one or more possible implementations, the first hanger loop includes a J-shaped hook, a lower end of the J-shaped hook forms the U-shaped first bearing portion, and the J-shaped hook further includes a connection arm of which one end is connected to the first bearing portion.

In one or more possible implementations, the first bearing portion has an inclined bottom surface being low in front and high in rear, and when the first hanging pin moves backward in the first bearing portion, the inclined bottom surface raises the cover plate to open the storage box; and/or when the first hanging pin moves forward in the first bearing portion, the inclined bottom surface lowers the cover plate to close the storage box.

In one or more possible implementations, the second hanger loop has a second bearing portion; and the second hanging pin is configured to be insertable into the second bearing portion from the front, and movable in the front-rear direction and/or the up-down direction in the second bearing portion.

In one or more possible implementations, the second hanging pin extends in the front-rear direction; the second hanger loop includes a hole extending in the front-rear direction, and the second bearing portion includes the hole; and the second hanging pin is inserted into the hole from the front to implement hanging of the second hanging pin and the second hanger loop.

In one or more possible implementations, the refrigeration appliance further includes a separator assembly located above the cover plate. The other end of the connection arm is connected to a side edge of the separator assembly and/or the second hanger loop is connected to a rear edge of the separator assembly.

In one or more possible implementations, the separator assembly further includes a separator, and a first edge strip connected to a front edge of the separator and/or a second edge strip connected to a rear edge of the separator; and the other end is connected to the first edge strip, and the second hanger loop is connected to the second edge strip.

In one or more possible implementations, a surface in which the second hanging pin is in contact with the second bearing portion has an inclined bottom surface being low in front and high in rear; and/or a surface in which the second bearing portion is in contact with the second hanging pin has an inclined bottom surface being low in front and high in rear; and when the second hanging pin moves backward in the second bearing portion, the inclined bottom surfaces raise the cover plate to open the storage box; and/or when the second hanging pin moves forward in the second bearing portion, the inclined bottom surfaces lower the cover plate to close the storage box.

In one or more possible implementations, the refrigeration appliance further includes a sliding pin and a first sliding groove, the sliding pin is adapted to move in a left-right direction relative to the storage box; and the first sliding groove is located on the cover plate and extends obliquely backward from left to right or from right to left; the sliding pin is inserted into the first sliding groove and moves in the first sliding groove; and when moving, the sliding pin is abutted against side walls of the first sliding groove to cause the cover plate to move forward or backward when the sliding pin slides in the first sliding groove.

In one or more possible implementations, the refrigeration appliance further includes a second sliding groove communicating with the first sliding groove. The second sliding groove extends in the front-rear direction; both the first sliding groove and the second sliding groove are recessed downward relative to an upper surface of the cover plate, a recessed depth of the first sliding groove is greater than a recessed depth of the second sliding groove; and the sliding pin is able to slide into the first sliding groove from the upper surface (24) of the cover plate or from a bottom wall of the second sliding groove.

In one or more possible implementations, a step wall is disposed in a transition region between the first sliding groove and the second sliding groove; and the step wall is higher than a lower end of the sliding pin to prevent the lower end of the sliding pin from sliding into the second sliding groove.

In one or more possible implementations, the refrigeration appliance is switchable from a first state to a second state; when the refrigeration appliance is in the first state, the lower end of the sliding pin is abutted against the upper surface of the cover plate or the bottom wall of the second sliding groove; and when the refrigeration appliance is in the second state, the lower end of the sliding pin is located in the first sliding groove.

In one or more possible implementations, the switching from the first state to the second state includes that the cover plate moves backward.

In one or more possible implementations, when the refrigeration appliance is in the first state, the first hanging pin is located outside the first hanger loop and/or the second hanging pin is located in the second hanger loop; when the refrigeration appliance is in the second state, the first hanging pin is located in the first bearing portion; and the switching from the first state to the second state includes that the first hanging pin enters the first hanger loop from the open section.

In one or more possible implementations, the switching from the first state to the second state includes downward movement of the cover plate.

In one or more possible implementations, the switching from the first state to the second state includes that the sliding pin slides into the first sliding groove from the upper surface of the cover plate or from the bottom wall of the second sliding groove.

In one or more possible implementations, the refrigeration appliance further includes a separator assembly located above the cover plate. The first hanger loop is disposed on a side wall of a cabinet of the refrigeration appliance or on a left side and/or a right side of a front end of the separator assembly; and the second hanger loop is disposed on a rear wall of the cabinet of the refrigeration appliance or behind the separator assembly.

In one or more possible implementations, a front end of the second sliding groove communicates with a rear end of the first sliding groove.

Other features which are considered as characteristic for the invention are set forth in the appended claims.

Although the invention is illustrated and described herein as embodied in a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The technical solution of the present application is clearly and completely described below through specific embodiments. It will be understood that the described embodiments are merely some rather than all of the embodiments of this application. Based on the embodiments in the application, all other embodiments obtained by a person skilled in the art without paying any creative efforts all fall within the protection scope of the application.

The embodiment of the present invention provides for one or more refrigeration appliances 100.

Figure 1:
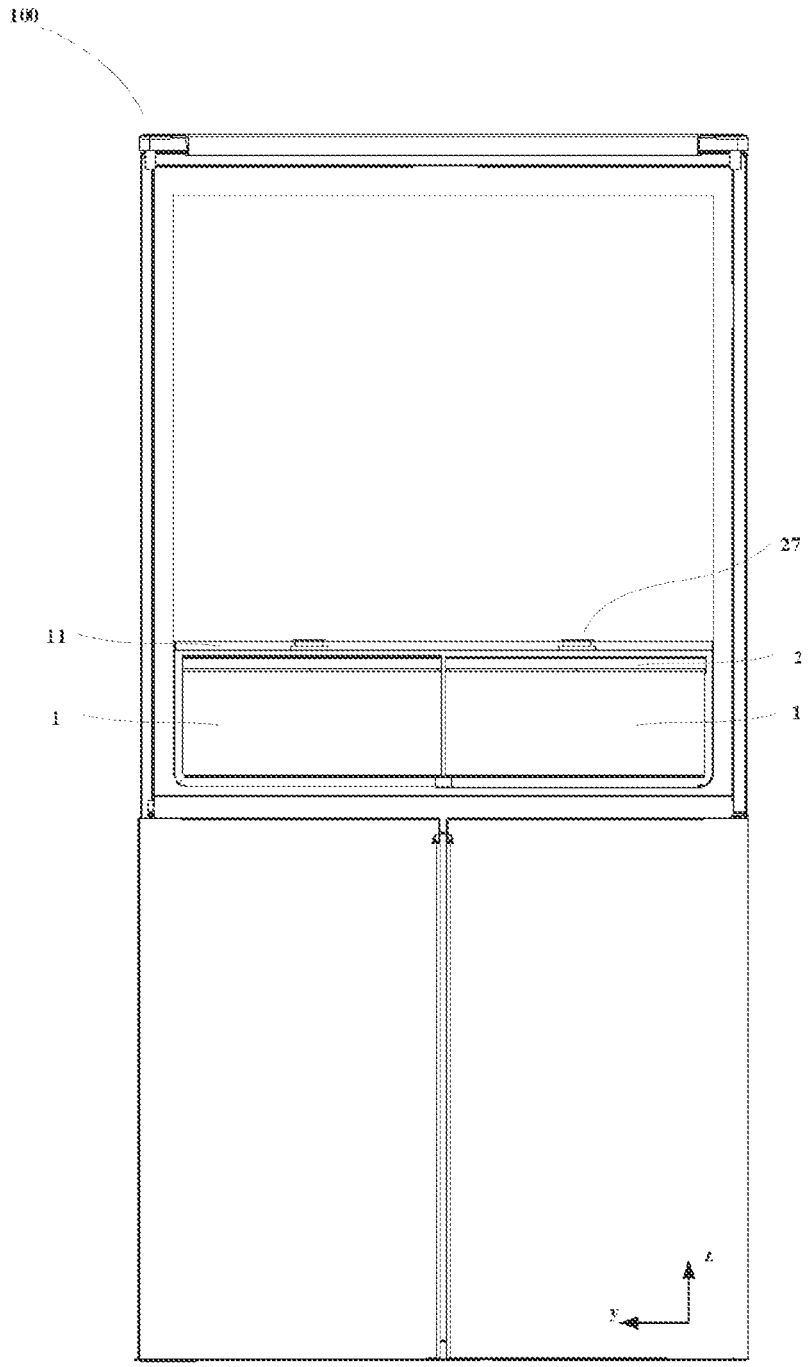
FIG. 1 is a schematic structural diagram of a refrigeration appliance according to one or more embodiments of the present invention.
Figure 2:
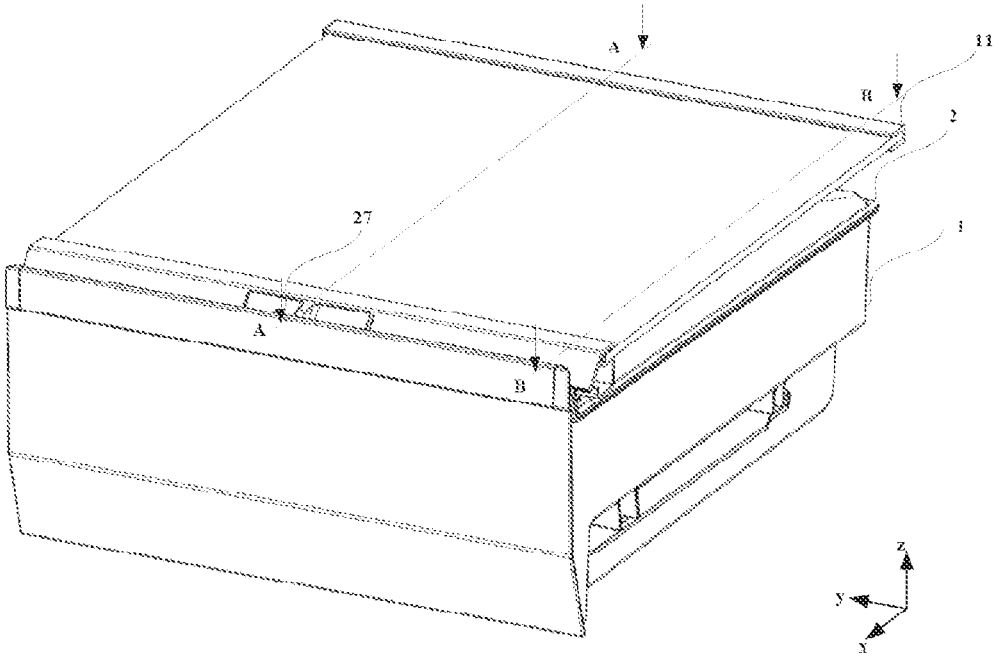
FIG. 2 is a schematic partial structural diagram of the refrigeration appliance according to one or a plurality of embodiments of the present invention, and shows a schematic structural diagram of a storage box, a cover plate and a separator assembly.

Referring now to the figures of the drawing in detail, and first to FIG. 1 thereof, there is shown a schematic structural diagram of a refrigeration appliance according to one or more embodiments of the present invention. FIG. 2 is a schematic local structural diagram of the refrigeration appliance according to one or more embodiments, and shows a structure of a storage box, a cover plate and a separator assembly.

The refrigeration appliance 100, by way of example, may be a refrigerator or a wine cabinet. The refrigeration appliance 100 includes a storage box 1 with an upper end being open and a cover plate 2. The cover plate 2 can move relative to the storage box 1. The cover plate 2 can open and close the storage box 1 in moving. By way of example, the above storage box 1 may be used for article storage and the cover plate 2 may be used as a storage device of the refrigeration appliance 100 with humidity adjusting capability or temperature adjusting capability.

For example, when a humidity or temperature in the storage box 1 is within a target range, the cover plate 2 closes the storage box 1 to reduce exchange between gas in the storage box 1 and outside and maintain the humidity or temperature. When the humidity or temperature in the storage box 1 is not within the target range, the cover plate 2 is moved to open the storage box 1, the gas in the storage box 1 generates exchange with the outside gas, so that the humidity or temperature is adjusted. After the humidity or temperature reaches the target range, the storage box 1 can be closed again to reduce the exchange between the gas in the storage box 1 and the outside.

Figure 3:
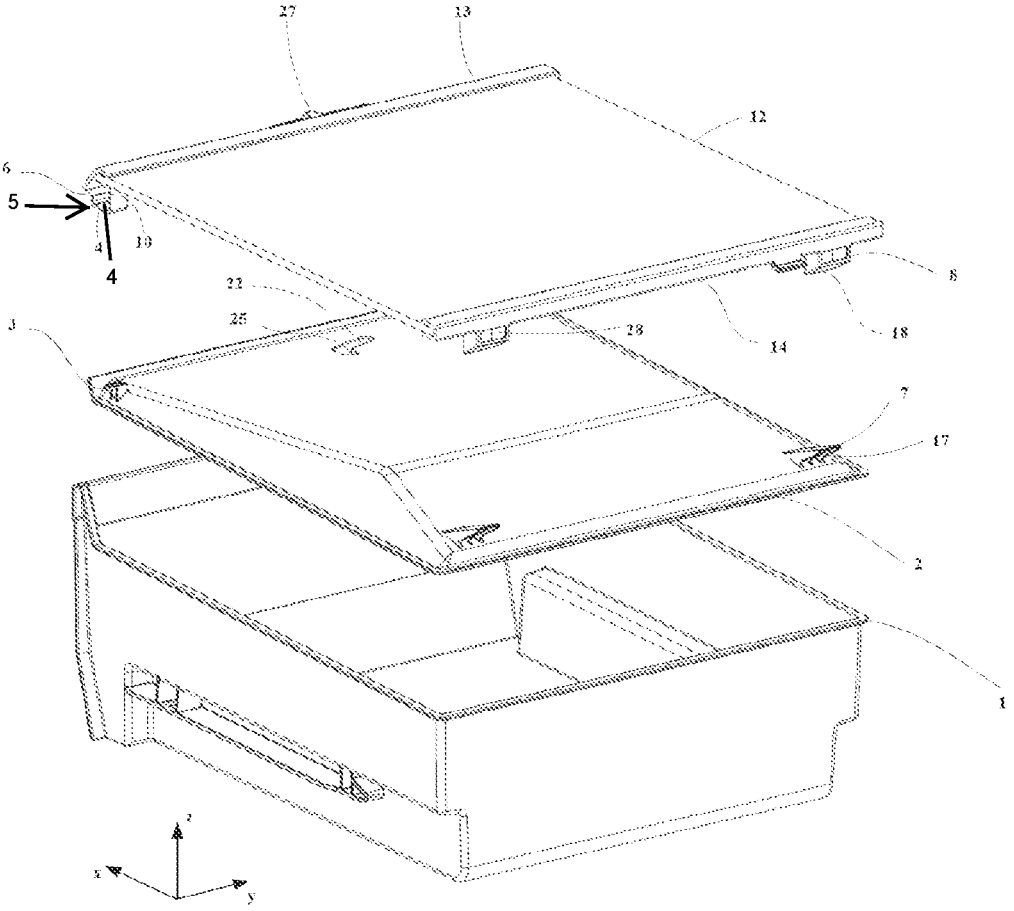
FIG. 3 is an exploded view of a local structure of the refrigeration appliance according to one or a plurality of embodiments of the present invention, and shows a schematic structural diagram of the storage box, the cover plate, the separator assembly and other components.
Figure 4:
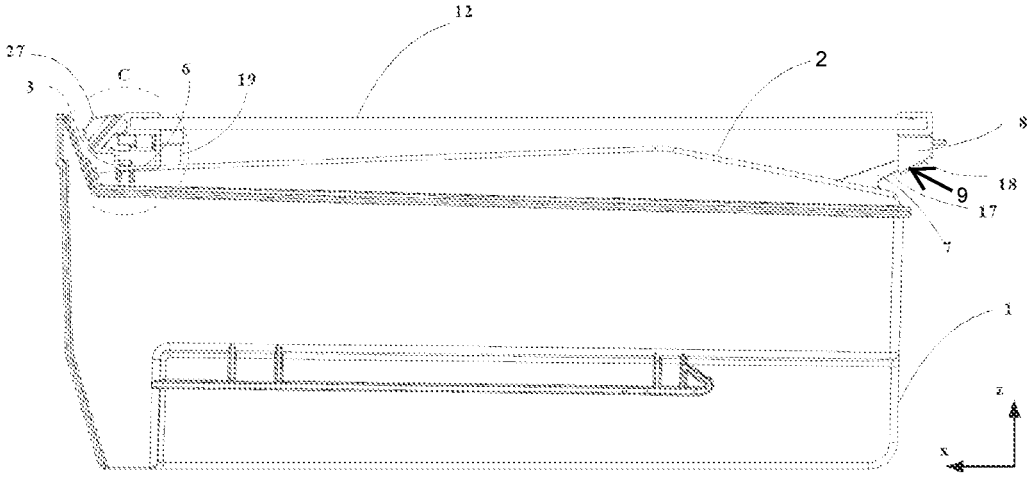
FIG. 4 is a sectional view along the line B-B in FIG. 2, and shows a schematic structural diagram of the storage box, the cover plate and the separator assembly.
Figure 5:
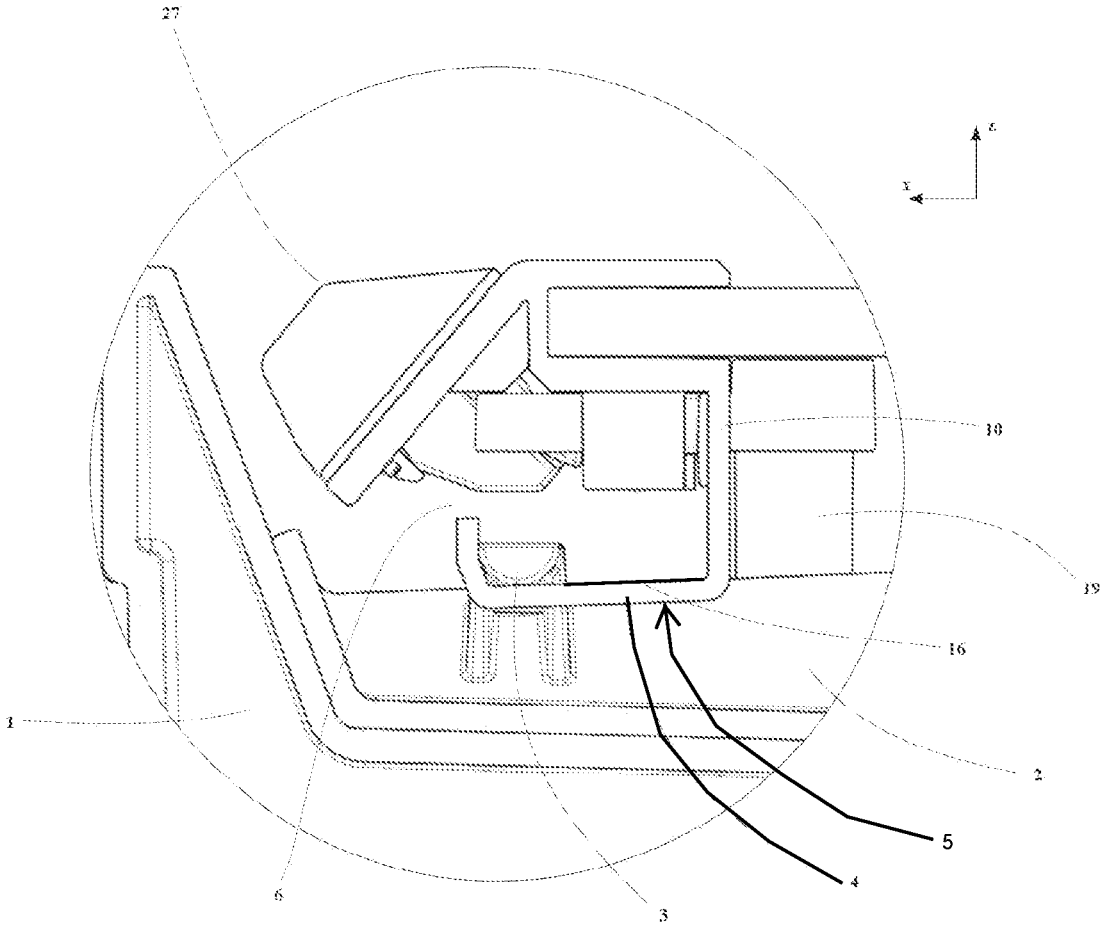
FIG. 5 is a partial enlarged diagram of a portion C in FIG. 4, and shows a schematic detail structural diagram at a first hanging pin and a first hanger loop.

Referring to FIG. 3 to FIG. 5, in one or more possible embodiments, the refrigeration appliance 100 further includes a first hanger loop 5 and a second hanger loop 8, and a first hanging pin 3 and a second hanging pin 7 disposed on the cover plate 2. The first hanging pin 3 is hung in the first hanger loop 5, and the second hanging pin 7 is hung in the second hanger loop 8. Additionally, the first hanging pin 3 is movable in a front-rear direction and/or an up-down direction in the first hanger loop 5, the second hanging pin 7 is movable in the front-rear direction and/or the up-down direction in the second hanger loop 8, and the cover plate 2 is movable in the front-rear direction and/or the up-down direction due to the movement of the first hanging pin 3 and the second hanger loop 8.

When the cover plate 2 is located right above the opening of the storage box 1, the storage box 1 can be closed. After the cover plate 2 moves in the front-rear direction and/or the up-down direction, the cover plate 2 moves away from the opening of the storage box 1 so that the storage box 1 is opened.

It can be understood that the movement of the cover plate 2 can be continuous, so that the change between the completely opened state and the closed state is continuous, and a user can select to totally open or partially open the storage box 1.

Further, the first hanger loop 5 includes an open section 6. The first hanging pin 3 can enter the first hanger loop 5 from the open section 6.

Under the guidance of the present invention, those in the art can reasonably set the dimension of the first hanging pin 3 and the open section 6 to enable the first hanging pin 3 to enter the first hanger loop 5 from the open section 6.

The cover plate 2 is hung on the hanger loops through the hanging pins, the cover plate 2 is driven to move for opening and closing the storage box 1 through the movement of the hanging pins in the hanger loops. The structure is simple and reliable. Particularly, the first hanger loop 5 is provided with the open section 6, the first hanging pin 3 can enter the hanger loop from the open section 6 of the hanger loop, and the cover plate 2 and/or the first hanging pin 3 do/does not need to be bent to be inserted into the first hanger loop 5, so that the mounting and/or dismounting of the cover plate 2 are/is very convenient.

The first hanger loop 5 and/or the second hanger loop 8 can be disposed on a cabinet of the refrigeration appliance 100, and can also be disposed on an attachment of the cabinet, such as the separator assembly 11 or dividing wall.

In one or more possible implementations, not shown in the figures, the first hanger loop 5 is disposed on a side wall of the cabinet of the refrigeration appliance 100, and can be a hanger loop in an inward recessed or outward produced form at the side wall of the cabinet. The first hanger loop 5 can also be connected onto the side wall of the cabinet in an attachment form.

In one or more possible implementations, the second hanger loop 8 is disposed on a rear wall of the cabinet of the refrigeration appliance 100, and can be a hanger loop in an inward recessed or outward produced form at the rear wall of the cabinet. The second hanger loop 8 can also be connected onto the rear wall of the cabinet in an attachment form.

In one or more possible implementations, as shown in FIG. 2 to FIG. 6, the refrigeration appliance 100 further includes a separator assembly 11 located on the cover plate 2. The first hanger loop 5 is connected to a left side and/or a right side of the front end of the separator assembly 11, and the second hanger loop 8 is connected to the rear end of the separator assembly 11.

The first hanging pin 3 can be relatively close to the front end of the cover plate 2, and the second hanging pin 7 can be relatively close to the rear end of the cover plate 2. In such a way, the stress is more uniform, and the cover plate 2 cannot easily fall off while moving.

Continuing to refer to FIG. 3 to FIG. 5, in one or more possible implementations, the first hanging pin 3 is located at the front end of the side edge of the cover plate 2 and extends from the cover plate to a left side or a right side, and a front portion and/or a top portion of the first hanger loop 5 is provided with the open section 6. Through such arrangement, the cover plate 2 can be installed to a preset position from the front side.

In one or more possible implementations, the second hanging pin 7 is located at the rear end of the cover plate 2 and extends to the rear side.

The first hanger loop 5 and the second hanger loop 8 respectively include a first bearing portion 4 and a second bearing portion 9 extending in the front-rear direction, so that the first hanging pin 3 and the second hanging pin 7 respectively move in the first bearing portion 4 and the second bearing portion 9 in the front-rear direction.

Exemplarily, the first hanger loop 5 may be a J-shaped hook, a bent section at a lower portion of the J-shaped hoop form the first bearing portion 4. A long arm of the J-shaped hook is a connection arm 10, one end is connected with the first bearing portion 4, and the other end 15 is connected to the cabinet or the attachment of the cabinet, such as the separator assembly 11. The short arm side of the J-shaped hook can form the open section 6, and the first hanger loop 5 can enter the first bearing portion 4 from the open section 6.

Exemplarily, the second hanger loop 8 includes a hole 28 extending in the front-rear direction, and the hole 28 can be used as at least one portion of the bearing portion. The second hanging pin 7 can be inserted into the hole 28 from a front end of the hole 28, and is movable in the hole 28 in the front-rear direction.

Referring to FIG. 3 to FIG. 5, in one or more possible implementations, the first bearing portion 4 includes an inclined bottom surface being low in front and high in rear. When the first hanging pin 3 slides backward in the first bearing portion 4, the inclined bottom surface gradually raises the first hanging pin 3, the cover plate 2 upward and backward moves to open the storage box 1 at least partially. In an opposite process, when the first hanging pin 3 slides from the rear to the front in the first bearing portion 4, the inclined bottom surface gradually lowers the first hanging pin 3, the cover plate 2 downward and forward moves to reduce the open degree of the cover plate 2 and the storage box 1 or gradually close the storage box 1.

Referring again to FIG. 3 to FIG. 5, in one or more possible implementations, the second bearing portion 9 includes an inclined bottom surface being low in front and high in rear. When the second hanging pin 7 slides backward in the second bearing portion 9, the inclined bottom surface is in contact with the second hanging pin 7, the inclined bottom surface gradually raises the second hanging pin 7, the cover plate 2 upward and backward moves to open the storage box 1 at least partially. In an opposite process, when the second hanging pin 7 slides from the rear to the front in the second bearing portion 9, the inclined bottom surface gradually lowers the second hanging pin 7, the cover plate 2 downward and forward moves to reduce the open degree of the cover plate 2 and the storage box 1 or gradually close the storage box 1.

Referring to FIG. 3 to FIG. 5, in one or more possible implementations, the second hanging pin 7 includes an inclined bottom surface being in contact with the second hanger loop 8 and being low in front and high in rear. When the second hanging pin 7 slides backward in the second bearing portion 9, the inclined bottom surface is in contact with the second bearing portion 9, the inclined bottom surface gradually raises the second hanging pin 7, the cover plate 2 upward and backward moves to open the storage box 1 at least partially. In an opposite process, when the second hanging pin 7 slides from the rear to the front in the second bearing portion 9, the inclined bottom surface gradually lowers the second hanging pin 7, the cover plate 2 downward and forward moves to reduce the open degree of the cover plate 2 and the storage box 1 or gradually close the storage box 1.

Referring to FIG. 1 to FIG. 4 and FIG. 6, in one or more possible implementations, the refrigeration appliance 100 further includes a separator assembly 11 located above the cover plate 2 and connected to the cabinet of the refrigeration appliance 100, and the separator assembly 11 can vertically separate the storage box 1 from other storage spaces of the refrigeration appliance 100. The storage space of the refrigeration appliance 100 is separated into two or more small storage spaces by the separator assembly 11, so that the utilization efficiency of the refrigeration appliance 100 can be increased.

Exemplarily, the separator assembly 11 includes a separator 12, and a first edge strip 13 connected to a front edge of the separator 12 and a second edge strip 14 connected to a rear edge of the separator 12.

The first hanger loop 5 and/or the second hanger loop 8 may be connected to the separator assembly 11.

Exemplarily, the first hanger loop 5 may be connected to a side edge of a front end of the separator assembly 11 and/or the second hanger loop 8 may be connected behind the separator assembly 11. Further, the first hanger loop 5 may be connected to the first edge strip 13 and/or the second hanger loop 8 may be connected to the second edge loop 14. A material with higher strength may be selected to manufacture the separator 12, and a material easier to form may be selected to manufacture the edge strips, thus ensuring the strength of the separator assembly 11 and reducing the manufacturing difficulty and manufacturing cost of the refrigeration appliance 100. For example, the glass separator 12 and the plastic first edge strip 13 and second edge strip 14 are used.

Through such arrangement, the manufacturing and installation of the refrigeration appliance 100 are convenient. On one hand, the first hanger loop 5 and/or the second hanger loop 8 formed on the cabinet of the refrigeration appliance 100 are/is reduced or unnecessary, the cabinet and the hanger loops can be assembled after being respectively processed and manufactured. On the other hand, the separator assembly 11 can be installed onto the refrigeration appliance 100 after the first hanger loop 5 and/or the second hanger loop 8 are installed onto the separator assembly 11, and the installation is more convenient.

Referring to FIG. 3 to FIG. 7, in one or more possible implementations, the refrigeration appliance 100 includes a sliding pin 19 and a first sliding groove 22.

The sliding pin 19 can leftward and rightward move relative to the storage box 1, and the sliding pin 19 extends in the up-down direction. The downward recessed first sliding groove 22 is formed in an upper surface of the cover plate 2. A lower end of the sliding pin 19 is inserted into the first sliding groove 22 at least partially.

The first sliding groove 22 backward extends in an inclined manner from the left to the right. When sliding from the left end to the right end in the first sliding groove 22, the sliding pin 19 abuts against a side wall 20 of the first sliding groove 22 to cause the cover plate 2 to move backward relative to the storage box 1. When sliding from the right end to the left end in the first sliding groove 22, the sliding pin 19 abuts against a side wall 21 of the first sliding groove 22 to cause the cover plate 2 to move forward relative to the storage box 1.

In one or more unshown implementations, the first sliding groove 22 may also extend backward from the right to the left, the sliding pin 19 can slide from the right end to the left end to drive the cover plate 2 to backward move, and the sliding pin 19 can slide from the left end to the right end to drive the cover plate 2 to forward move.

It can be understood that the storage box 1 can be opened and closed by forward and backward movement of the cover plate 2 relative to the storage box 1 in such a manner. Through the matched use with one or more of the inclined bottom surface 16, the inclined bottom surface 17 and the inclined bottom surface 18, the cover plate 2 can move forward and backward relative to the storage box 1 and can also vertically move relative to the storage box 1 to open and close the storage box 1.

Although the storage box 1 can be opened and closed through the forward and backward movement or vertical moment of the cover plate 2 relative to the storage box, if the vertical movement can be achieved during forward and backward movement, the open degree of the storage box 1 can be maximized in a relatively smaller moving space of the cover plate 2.

Referring to FIG. 2 to FIG. 6, in one or more possible implementations, the refrigeration appliance 100 further includes a slide block 27 connected with the separator assembly 11. The slide block 27 can leftward or rightward slide relative to the separator assembly 11. The other end 15 of the slide block 27 is connected with the sliding pin 19. Exemplarily, the slide block 27 can be connected to the first edge strip 13.

Figure 6:
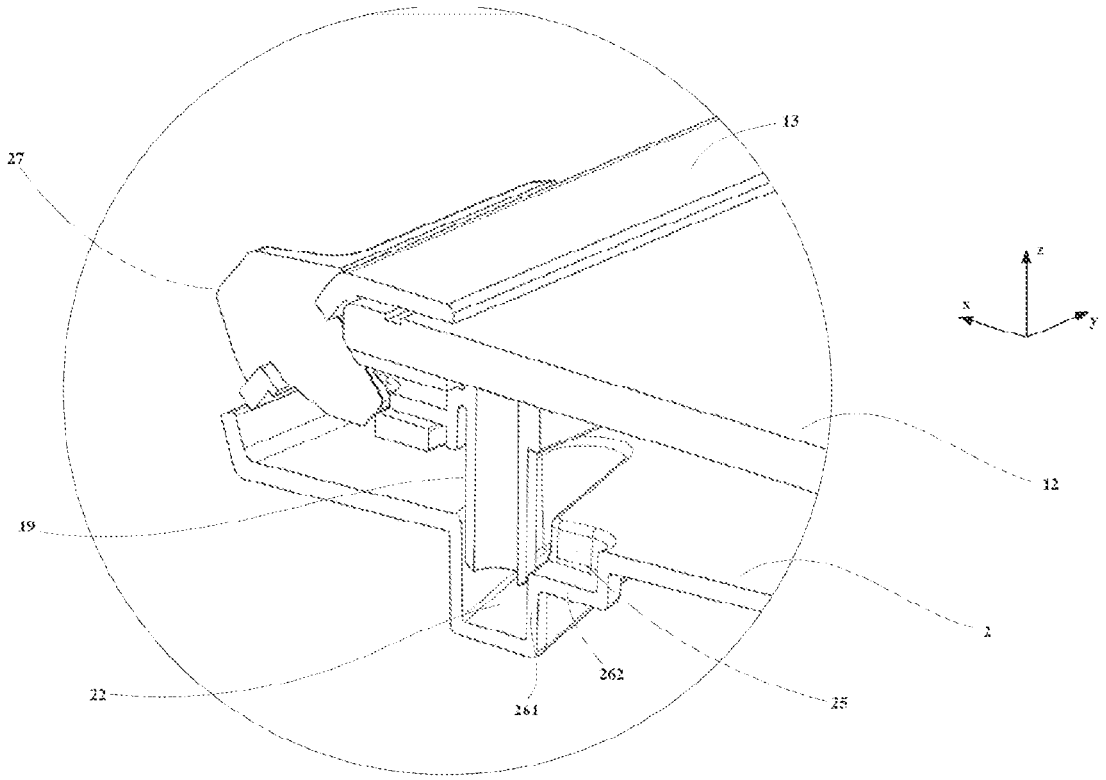
FIG. 6 is a partial portion of a sectional view along a line A-A in FIG. 2 and shows a schematic detail structural diagram at a sliding pin, a first sliding groove and a second sliding groove.
Figure 7:
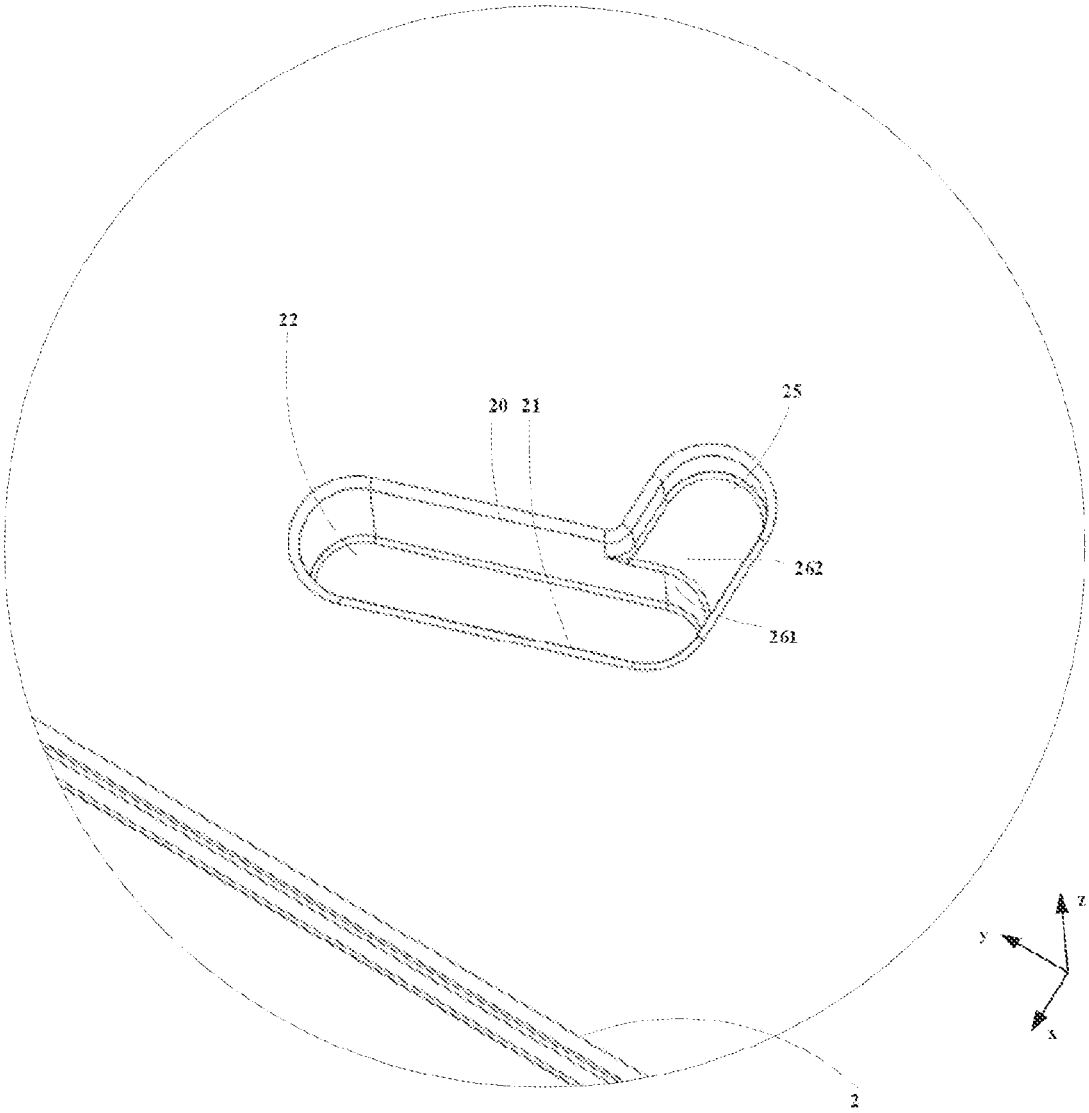
FIG. 7 is a partial structural diagram of the refrigeration appliance according to one or a plurality of embodiments of the present invention, and shows a schematic detail structural diagram at the first sliding groove and the second sliding groove.

Referring to FIG. 3, FIG. 6 and FIG. 7, in one or more possible implementations, a second sliding groove 25 connected with the first sliding groove 22 is further formed in the cover plate 2, the second sliding groove 25 is downward recessed relative to the cover plate 2, and extends in the front-rear direction, and the sliding pin 19 can slide into the first sliding groove 22 from the second sliding groove 25.

Exemplarily, when the sliding pin 19 is abutted against the upper surface behind the first sliding groove 22 of the cover plate 2 or located in the second sliding groove 25, the cover plate 2 is backward pushed, the sliding pin 19 slides into the first sliding groove 22 from the upper surface of the cover plate 2 or from the second sliding groove 25. The assembly of the sliding pin in the first sliding groove is completed in such a manner, and the operation is very convenient.

Exemplarily, the front end of the second sliding groove 25 communicates with the rear end of the first sliding groove 22. Through such arrangement, the sliding pin 19 can slide into the first sliding groove after the cover plate 2 backward slide for a small distance. When the first sliding groove 22 extends in an inclined manner from the right to the left, the front end of the second sliding groove 25 communicates with the left end of the first sliding groove 22. When the first sliding groove 22 extends in an inclined manner from the left to the right, the front end of the second sliding groove 25 communicates with the right end of the first sliding groove 22.

Exemplarily, a recessed depth of the first sliding groove 22 is greater than a recessed depth of the second sliding groove 25. A lower end of the sliding pin 19 can be abutted against the upper surface 24 of the cover plate 2 or the bottom wall 262 of the second sliding groove. When the cover plate 2 backward moves, the lower end of the sliding pin 19 slides into the first sliding groove 22 from the upper surface 24 or the bottom wall 262 of the second sliding groove.

Due to the existence of the second sliding groove 25, the lower end of the sliding pin 19 can be abutted against the bottom wall 262 of the second sliding groove 25 and does not need to be abutted against the upper surface of the cover plate 2. A height interval between the cover plate 2 and other assemblies above the cover plate 2 can be reduced, and an assembly space to be reserved is smaller. Therefore, after the assembly, the cover plate 2 cannot easily leave away from the assembly space. For example, when the separator assembly 11 is disposed above the cover plate 2, if no second sliding groove 25 is provided, a height between the separator assembly 11 of the assembly space and the upper surface of the cover plate 2 is at least a height of the sliding pin 19; and if the second sliding groove 25 is provided, the height between the separator assembly 11 and the upper surface of the cover plate 2 is at least a distance capable of reducing the depth of the second sliding groove 25. The height interval between the separator assembly 11 and the upper surface of the cover plate 2 is reduced, a moving space of the cover plate 2 can be reduced, and the falling possibility of the cover plate 2 is reduced.

A step wall 261 is disposed in a transition region between the first sliding groove 22 and the second sliding groove 25. After the sliding pin 19 slides into the first sliding groove 22, the step wall 261 can prevent the lower end of the sliding pin 19 from sliding into the second sliding groove 25 from the first sliding groove 22, and the falling possibility of the cover plate 2 is further reduced.

In one or more possible embodiments, not shown in the figures, the sliding pin 19 can move or do telescopic operation in the up-down direction.

When the lower end of the sliding pin 19 is abutted against the upper surface of the cover plate 2 or the bottom wall 262 of the second sliding groove 25, the sliding pin 19 is located in an upper position or is in a compressed state. After the lower end of the sliding pin 19 slides into the first sliding groove 22, the sliding pin 19 is located in a lower position or is in an extending state, the lower end of the sliding pin 19 is lower than the depth of the first sliding groove 22 or the height of the step wall 261, the sliding pin 19 cannot freely slide out of the first sliding groove 22, and the falling possibility of the cover plate 2 is reduced.

In one or more possible implementations, the refrigeration appliance 100 at least includes a first state and a second state. The first state can be changed into the second state. In the first state, the lower end of the sliding pin 19 is abutted against the upper surface of the cover plate 2 or the bottom wall 262 of the second sliding groove 25. In the second state, the lower end of the sliding pin 19 is located in the first sliding groove 22.

Further, a process of switching from the first state to the second process includes backward movement of the cover plate 2.

In the first state, the first hanging pin 3 is located outside the first hanger loop 5, and the second hanging pin 7 is located outside the second hanger loop 8 or hung in the second hanger loop 8. In the second state, the first hanger pin 3 is hung in the first hanger loop 5, and the second hanger pin 7 is also hung in the second hanger loop 8. The process of switching from the first state to the second state includes that the first hanging pin 3 enters the first hanger loop 5 from the open section 6; and if in the first state, the second hanging pin 7 is located outside the second hanger loop 8, the process of switching from the first state to the second state further includes inserting the second hanging pin 7 into the second hanger loop 8.

Further, a process of switching from the first state to the second process includes downward movement of the cover plate 2.

Further, the process of switching from the first state to the second state includes sliding the sliding pin 19 into the first sliding groove 22 from the upper surface of the cover plate 2 or the bottom wall 262 of the second sliding groove 25.

The principle of one or more embodiments of the present invention will be illustratively described hereafter in combination with the accompanying diagrams.

According to an embodiment in FIG. 3 to FIG. 4, the assembly process includes the following steps: step 1: the cover plate 2 backward moves to a position of the first state, at this moment, the first hanging pin 3 is located in front of the J-shaped hook, the sliding pin 19 moves to the rightmost end, and the sliding pin 19 is located at the bottom wall 262 of the second sliding groove 25; step 2, the cover plate 2 upward and backward moves to cause the first hanging pin 3 to enter the first hanger loop 5 from the open section 6, and in the moving process, the sliding pin 19 slides into the first sliding groove 22 from the bottom wall 262 of the second sliding groove 25; and step 3, the cover plate 2 downward moves, so that the first hanging pin 3 is located in the first bearing portion 4. In the first state, the second hanging pin 7 may have been hung on the second bearing portion 9; or may have not been hung on the second bearing portion 9, but may be hung on the second bearing portion 9 in a process that the cover plate 2 backward moves in the step 2.

After the assembly is completed, the sliding pin 19 leftward moves, the cover plate 2 forward and downward moves to close the storage box 1 and the sliding pin 19 moves from the left end of the first sliding groove 22 to the right end, and the cover plate 2 backward and upward moves to open the storage box 1.

It is worth noting that according to the above descriptions on the embodiments of the present invention, the direction when the refrigeration appliance is normally used is taken as the reference.

Although specific implementations have been described above, these implementations are not intended to limit the scope of the present disclosure, even if only one implementation is described with respect to specific features. The feature example provided in the present disclosure is intended to be illustrative rather than limiting, unless otherwise stated. During specific implementation, according to an actual requirement, in a technically feasible case, the technical features of one or more dependent claims may be combined with the technical features of the independent claims, and the technical features from the corresponding independent claims may be combined in any appropriate way instead of using just specific combinations listed in the claims.

The various specific implementations described above and shown in the accompanying drawings are only used to illustrate the present invention, but are not all of the present invention. Any variation made by a person of ordinary skill in the art to the present application within the scope of the basic technical concept of the present application shall fall within the protection scope of the present application.

The alternative expression "at least one of A or B," as used herein, should be interpreted to mean A, or B, or A and B. Similarly, the expression "A and/or B" should be understood to mean A, or B, or A and B.

The invention claimed is:

1. A refrigeration appliance, comprising:

a storage box having an open upper end;

a cover plate disposed on said storage box;

a first hanging pin and a second hanging pin disposed on said cover plate;

a first hanger loop and a second hanger loop;

said first hanging pin being hung in said first hanger loop and being movable in at least one of a front-rear direction or an up-down direction in said first hanger loop;

said second hanging pin being hung in said second hanger loop and being movable in at least one of the front-rear direction or the up-down direction in said second hanger loop;

said cover plate being movable in at least one of the front-rear direction or the up-down direction relative to said storage box to at least partially open and close the storage box;

said first hanger loop being formed with an open section enabling said first hanging pin to enter said first hanger loop via said open section; and a sliding pin adapted to move in a left-right direction relative to the storage box, a first sliding groove formed in said cover plate and extending obliquely backward from left to right or from right to left, and a second sliding groove extending in the front-rear direction and communicating with said first sliding groove; and both said first sliding groove and said second sliding groove being recessed downward relative to an upper surface of said cover plate, a recessed depth of said first sliding groove being greater than a recessed depth of said second sliding groove, and said sliding pin being able to slide into said first sliding groove from the upper surface of said cover plate or from a bottom wall of said second sliding groove.

2. The refrigeration appliance according to claim 1, wherein said first hanging pin is disposed at a front end of said cover plate and extends laterally from said cover plate to a left side or a right side, and said open section is formed in at least one of a front portion or a top portion of said first hanger loop.

3. The refrigeration appliance according to claim 2, wherein said first hanger loop comprises a U-shaped first bearing portion, said first hanger loop is configured to allow said first hanging pin to enter said first bearing portion from said open section and to allow said first hanging pin to move in at least one of the front-rear direction or the up-down direction in the first bearing portion.

4. The refrigeration appliance according to claim 3, wherein said first hanger loop comprises a J-shaped hook, a lower end of the J-shaped hook forms said U-shaped first bearing portion, and said J-shaped hook further comprises a connection arm having one end connected to said first bearing portion.

5. The refrigeration appliance according to claim 4, wherein said first bearing portion has an inclined bottom surface being relatively low in front and relatively high in rear, and when said first hanging pin moves backward in said first bearing portion, said inclined bottom surface raises said cover plate to open said storage box; and/or when said first hanging pin moves forward in said first bearing portion, said inclined bottom surface lowers said cover plate to close said storage box.

6. The refrigeration appliance according to claim 1, wherein said second hanger loop has a second bearing portion; and said second hanging pin is configured to insert into said second bearing portion from the front, and movable in at least one of the front-rear direction or the up-down direction in the second bearing portion.

7. The refrigeration appliance according to claim 6, wherein said second hanging pin extends from front to rear; said second hanger loop is formed with a hole extending in the front-rear direction, and said second bearing portion is formed with said hole; and said second hanging pin is inserted into said hole from the front to implement hanging of said second hanging pin and said second hanger loop.

8. The refrigeration appliance according to claim 4, further comprising a separator assembly located above said cover plate, wherein another end of said connection arm is connected to a side edge of said separator assembly and/or said second hanger loop is connected to a rear edge of said separator assembly.

9. The refrigeration appliance according to claim 8, wherein said separator assembly further comprises a separator, and a first edge strip connected to a front edge of the separator and/or a second edge strip connected to a rear edge of the separator; and the other end is connected to said first edge strip, and said second hanger loop is connected to said second edge strip.

10. The refrigeration appliance according to claim 6, wherein:

a surface at which said second hanging pin is in contact with said second bearing portion has an inclined bottom surface being low in front and high in rear; and/or a surface at which said second bearing portion is in contact with said second hanging pin has an inclined bottom surface being low in front and high in rear; and when said second hanging pin moves backward in said second bearing portion, said inclined bottom surfaces raise said cover plate to open said storage box; and when said second hanging pin moves forward in said second bearing portion, said inclined bottom surfaces lower said cover plate to close said storage box.

11. The refrigeration appliance according to claim 1, wherein a step wall is formed in a transition region between said first sliding groove and said second sliding groove; and said step wall is higher than a lower end of said sliding pin to prevent said lower end of said sliding pin from sliding into said second sliding groove.

12. The refrigeration appliance according to claim 1, wherein the refrigeration appliance is switchable from a first state to a second state, and wherein:

when the refrigeration appliance is in the first state, the lower end of said sliding pin abuts against said upper surface of said cover plate or a bottom wall of said second sliding groove; and when the refrigeration appliance is in the second state, the lower end of said sliding pin is located in said first sliding groove.

13. The refrigeration appliance according to claim 12, wherein a switching from the first state to the second state causes said cover plate to move backward.

14. The refrigeration appliance according to claim 13, wherein when the refrigeration appliance is in the first state, said first hanging pin is located outside said first hanger loop, and/or said second hanging pin is located in said second hanger loop; when the refrigeration appliance is in the second state, said first hanging pin is located in the first bearing portion; and the switching from the first state to the second state comprises that said first hanging pin enters said first hanger loop from the open section.

15. The refrigeration appliance according to claim 13, wherein, upon switching from the first state to the second state, said cover plate moves downward.

16. The refrigeration appliance according to claim 12, wherein, upon switching from the first state to the second state, said sliding pin slides into said first sliding groove from the upper surface of said cover plate or from said bottom wall of said second sliding groove.

17. The refrigeration appliance according to claim 1, further comprising a separator assembly located above said cover plate, wherein said first hanger loop is disposed on a side wall of a cabinet of the refrigeration appliance or on at least one of a left side or a right side of a front end of said separator assembly; and said second hanger loop is disposed on a rear wall of the cabinet of the refrigeration appliance or behind said separator assembly.

18. The refrigeration appliance according to claim 1, wherein a front end of said second sliding groove communicates with a rear end of said first sliding groove.

* * * * *